US006412647B1

(12) United States Patent
Ko

(10) Patent No.: US 6,412,647 B1
(45) Date of Patent: Jul. 2, 2002

(54) MODULAR RACK

(76) Inventor: Hsi-Huang Ko, N. 129, Ting-Hsing Rd., Ting-Hsing Village, Shen-Kang Hsiang, Chan Hua Hsien (TW)

( * ) Notice: Subject to any disclaimer, the term of this patent is extended or adjusted under 35 U.S.C. 154(b) by 0 days.

(21) Appl. No.: 09/870,555

(22) Filed: Jun. 1, 2001

(51) Int. Cl.[7] ..... A47F 5/08
(52) U.S. Cl. ..... 211/106; 211/90.03; 211/88.01
(58) Field of Search ..... 211/181.1, 90.03, 211/106, 103, 133.5, 88.01

(56) References Cited

U.S. PATENT DOCUMENTS 618,425 A * 1/1899 Manger
2,903,137 A * 9/1959 Brown ..... 211/26
2,990,066 A * 6/1961 Annett ..... 211/106
D285,156 S * 8/1986 Chap
D295,126 S * 4/1988 Chap
D318,349 S * 7/1991 Nass ..... 211/106 X
5,272,991 A * 12/1993 Carrigan ..... 211/193 X
5,460,279 A * 10/1995 Emery et al. ..... 211/106
6,089,387 A * 7/2000 Varfolomeeva ..... 211/106

* cited by examiner

*Primary Examiner*—Robert W. Gibson, Jr.
(74) *Attorney, Agent, or Firm*—Harrison & Egbert

(57) ABSTRACT

A modular rack is formed of a plurality of structural units, with each including a plurality of retaining frames and retaining members equal in number to the retaining frames. The structural units are fitted together such that the retaining frames of one of the structural units are retained by the retaining members of another one of the structural units.

3 Claims, 5 Drawing Sheets

MODULAR RACK

BACKGROUND OF THE INVENTION

1. Field of the Invention

The present invention relates generally to a rack, and more particularly to a modular rack.

2. Description of Related Art

The conventional rack is generally attached to the wall as an independent unit for holding articles. When additional racks are needed, they must be independently set up or attached to the wall. As a result, the wall appearance is often seriously undermined by the fastening means by which the racks are attached to the wall. They also pose a space problem.

BRIEF SUMMARY OF THE INVENTION

The primary objective of the present invention is to provide a modular rack to alleviate the problems of the conventional racks described above.

In keeping with the principle of the present invention, the foregoing objective of the present invention is achieved by a modular rack which is formed of a plurality of units of standardized size, design, etc. The units are provided with a plurality of retaining members by which the units are arranged together.

The features and the advantages of the present invention will be more readily understood upon a thoughtful deliberation of the following detailed description of the present invention with reference to the accompanying drawings.

DETAILED DESCRIPTION OF THE INVENTION

As shown in FIGS. 1–6, a modular rack "A" of the present invention is formed of a plurality of units which are either similar or different in form.

Figure 1:
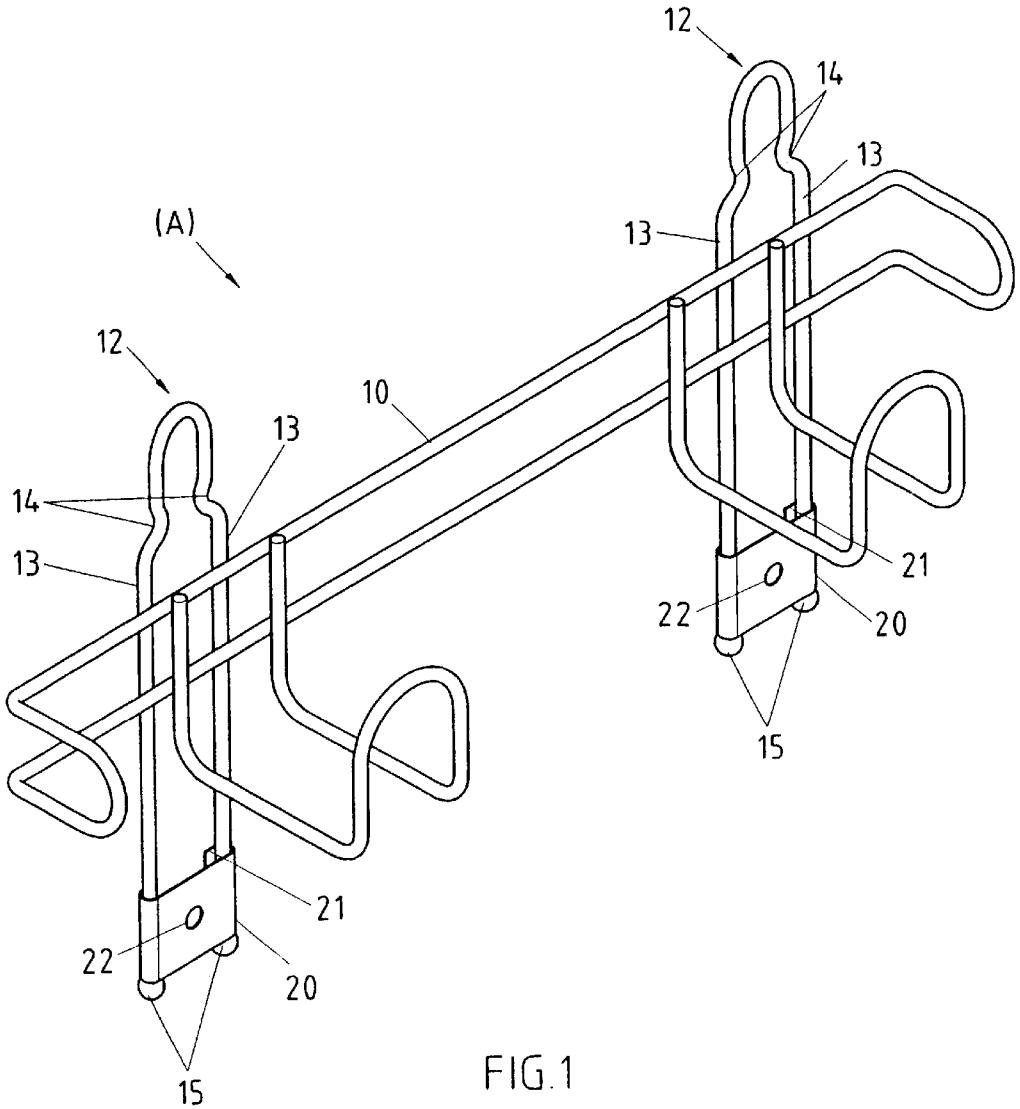
FIG. 1 shows a perspective view of a structural unit of the present invention.

As shown in FIG. 1, a structural unit 10 of the present invention comprises two elongated and inverted U-shaped retaining frames 12 and two retaining members 20. Each U-shaped frame 12 has two arms 13, two depressions 14, and two spherical ends 15 located at the free ends of the two arms 13. The retaining members 20 are provided with two receiving portions 21 and a center through hole 22. The retaining members 20 are fastened to the wall by an appropriate fastening means or a screw 23 which is fastened onto a wall "B" as shown in FIG. 5.

Figure 2:
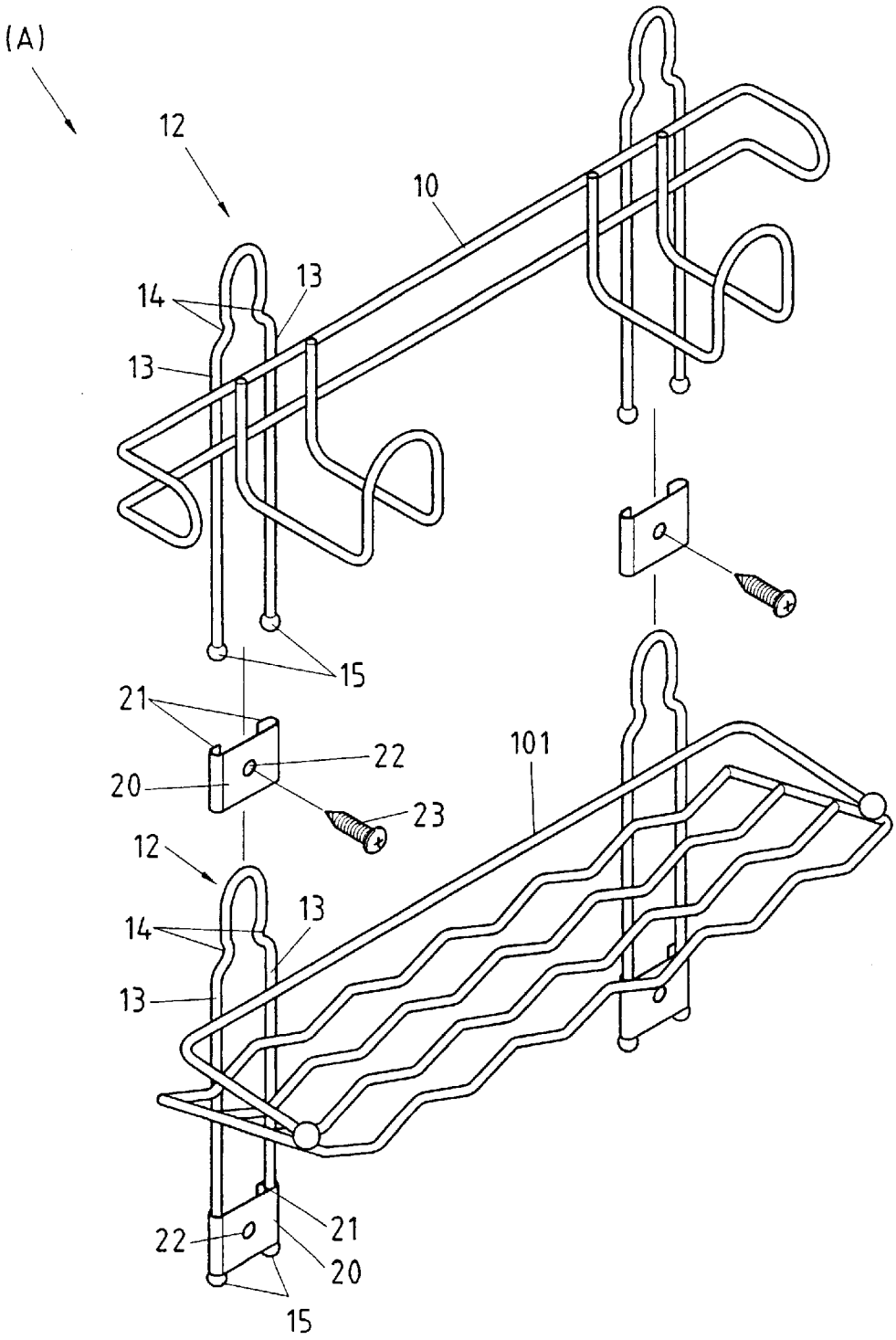
FIG. 2 shows an exploded view of the present invention comprising two different structural units.

As shown in FIG. 2, another structural unit 101 of the present invention comprises two elongated and inverted U-shaped retaining frames 12 and two retaining member 20. The structural units 10 and 101 are different in form such that they are provided with the article-holding portions different in form, so as to facilitate the holding of articles of different natures.

Figure 3:
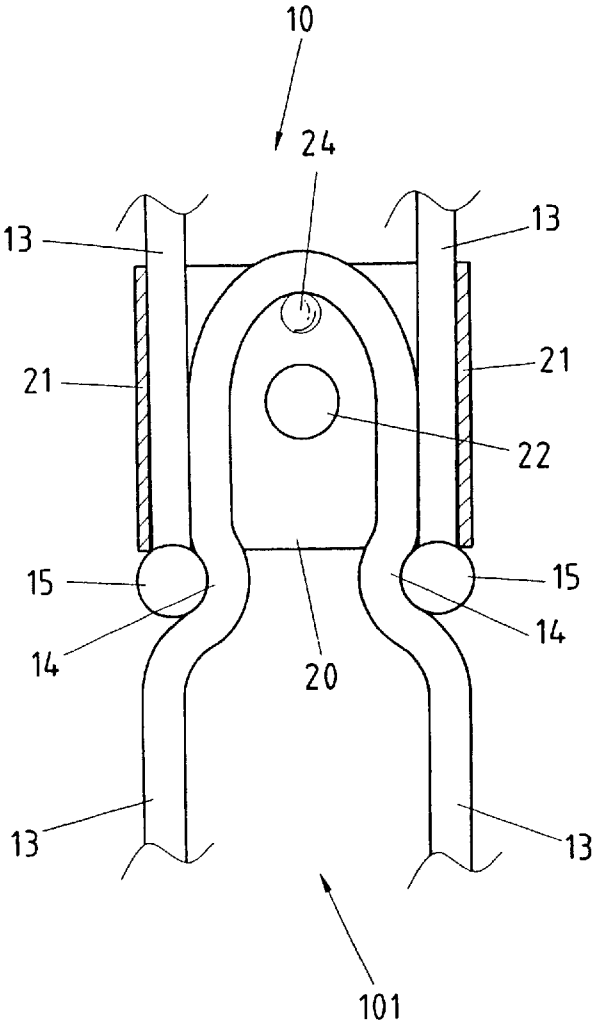
FIG. 3 shows a sectional schematic view of a juncture of the two structural units of the present invention.

The modular rack of the present invention may be formed of a plurality of the structural units 10, which are joined together by means of the retaining frames 12 and the retaining members 20. The modular rack of the present invention may be formed of the structural units 10 and 101, which are joined together by the frames 12 and the retaining members 20, as shown in FIG. 3. The head portion of the retaining frame 12 of the unit 101 is retained by the retaining member 20 of the unit 10, while the two spherical ends 15 of the two arms 13 of the frame 12 of the unit 10 are rested in the depressions 14 of the frame 12 of the unit 101. The two arms 13 of the frame 12 of the unit 10 are received in the receiving portions 21 of the retaining member 20.

Figure 4:
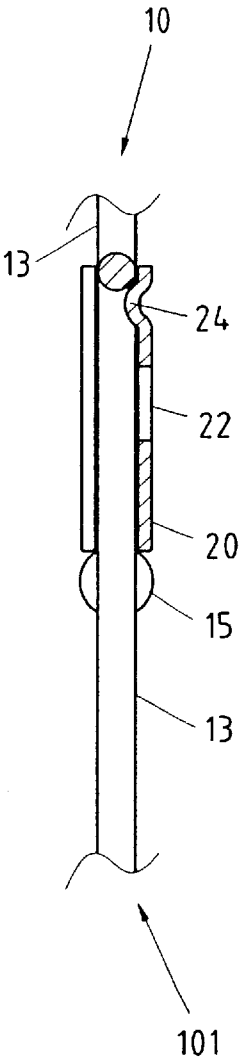
FIG. 4 is a side schematic view of FIG. 3.
Figure 5:
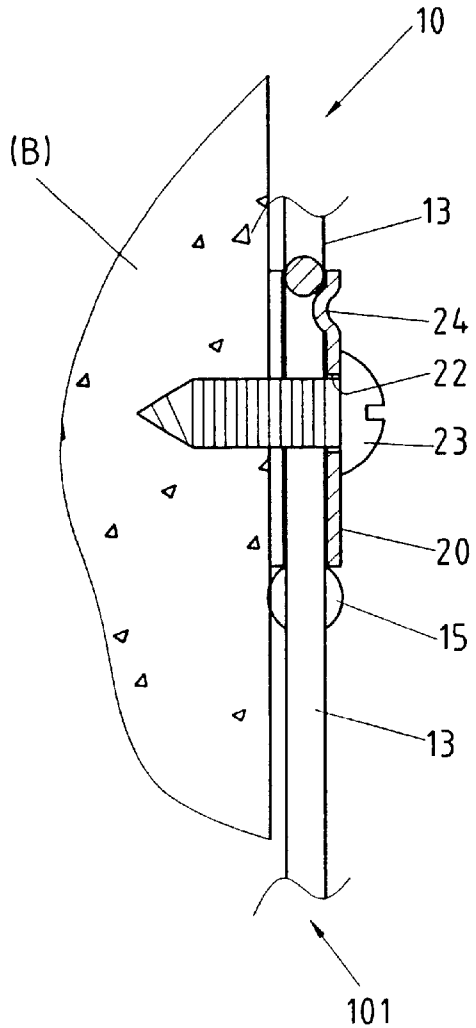
FIG. 5 shows a sectional schematic view of the retaining member of the present invention which is fastened onto a wall.
Figure 6:
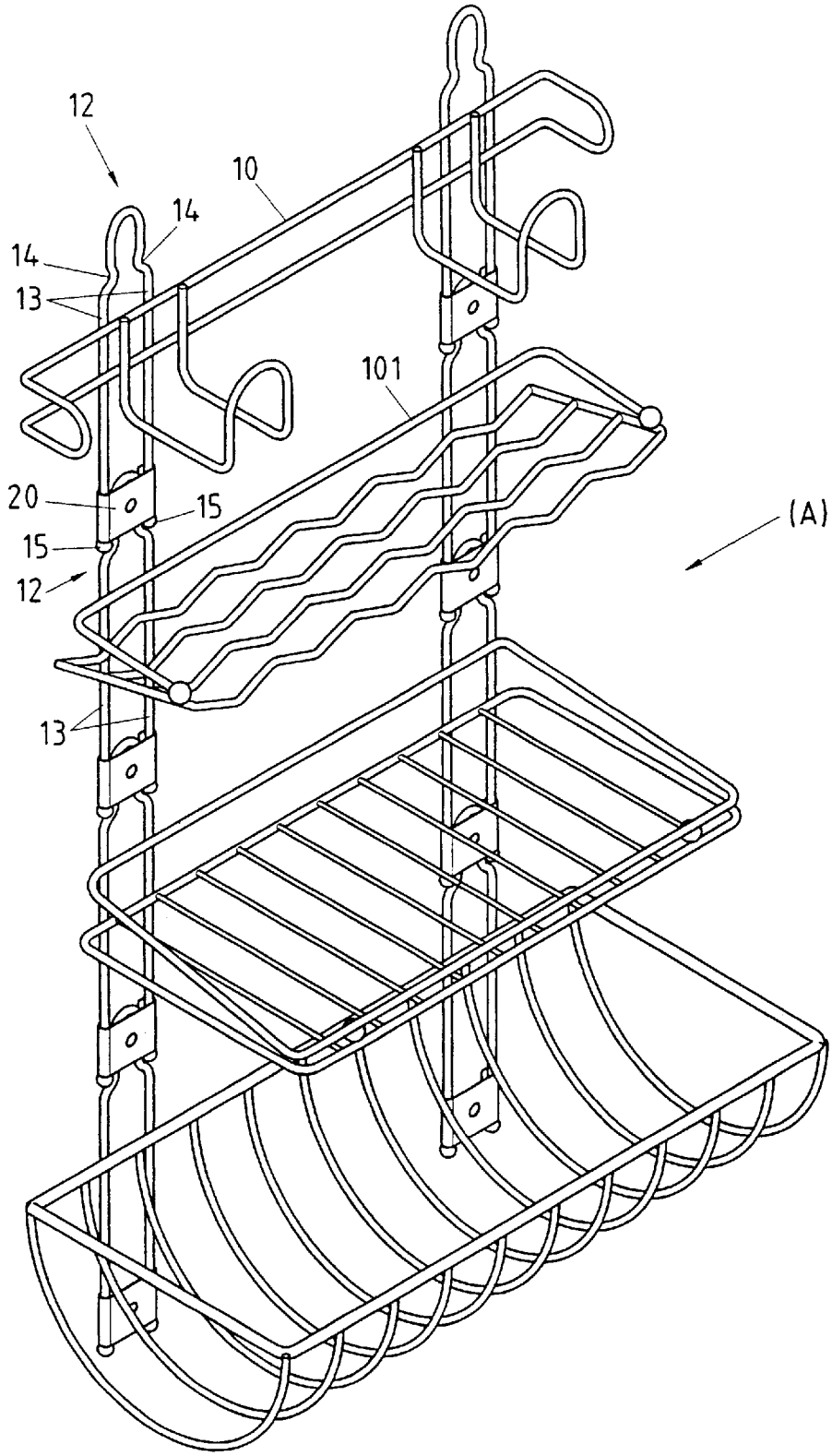
FIG. 6 shows a perspective view of a modular rack of the present invention.

As shown in FIGS. 3–5, the retaining member 20 is further provided with a protrusion 24 which is located in alignment with the center hole 22 and above the center hole 22. The protrusion 24 is intended to give an added support to the arcuate head portion of the frame 12.

The present invention described above is to be regarded in all respects as being merely illustrative and not restrictive. Accordingly, the present invention may be embodied in other specific forms without deviating from the spirit thereof. The present invention is therefore to be limited only by the scope of the following claims.

I claim:

1. A modular rack comprised of a plurality of structural units, with each comprising an article-holding frame, and a plurality of retaining frames and retaining members equal in number to said retaining frames; wherein said retaining frames are comprised of an inverted U-shaped construction having an arcuate head portion, two arms extending from said arcuate head portion, two depressions, and two spherical ends located at free ends of said two arms; wherein said retaining members are provided with two receiving portions opposite to each other; wherein said structural units are fitted together such that said arcuate head portion of said retaining frame of one of said structural units is retained by said retaining member of another one of said structural units, and such that said spherical ends of said arms of said retaining frame of said one of said structural units are rested in said depressions of said retaining frame of said other one of said structural units, and further that said two arms of said retaining frame of said one of said structural units are received in said receiving portions of said retaining member.

2. The modular rack as defined in claim 1, wherein said retaining members further comprise a center through hole, said retaining members being fastened to a surface by a fastening screw which is fastened onto the surface via said center through hole.

3. The modular rack as defined in claim 1, wherein said retaining members are further comprised of a protrusion; wherein said arcuate head portion of said retaining frame of said one of said structural units is supported by said protrusion of said retaining member of said other one of said structural units.

* * * * *